US005413458A

United States Patent [19]

Calderbank

[11] Patent Number: 5,413,458

[45] Date of Patent: May 9, 1995

[54] TURBINE VANE WITH A PLATFORM CAVITY HAVING A DOUBLE FEED FOR COOLING FLUID

[75] Inventor: John C. Calderbank, Glastonbury, Conn.

[73] Assignee: United Technologies Corporation, Hartford, Conn.

[21] Appl. No.: 219,316

[22] Filed: Mar. 29, 1994

[51] Int. Cl.[6] ..... F01D 5/18

[52] U.S. Cl. ..... 415/115; 415/116

[58] Field of Search ..... 415/115, 116; 416/96, 416/97

[56] References Cited

U.S. PATENT DOCUMENTS

| | | | |
|---|---|---|---|
| 3,433,015 | 3/1969 | Sneeden | 60/39.36 |
| 3,515,499 | 6/1970 | Beer et al. | 416/95 |
| 3,527,543 | 9/1970 | Howald | 416/90 |
| 3,529,902 | 9/1970 | Emmerson | 415/115 |
| 3,610,769 | 10/1971 | Schwedland et al. | 415/115 |
| 3,628,880 | 12/1971 | Smuland et al. | 415/115 |
| 3,644,060 | 2/1972 | Bryan | 416/97 |
| 3,726,604 | 4/1973 | Helms et al. | 415/115 |
| 3,800,864 | 4/1974 | Hauser et al. | 165/47 |
| 4,017,213 | 4/1977 | Przirembel | 416/97 A |
| 4,040,767 | 8/1977 | Dierberger et al. | 415/115 |
| 4,353,679 | 10/1982 | Hauser | 415/115 |
| 4,672,727 | 6/1987 | Field | 29/156.8 B |
| 4,767,260 | 8/1988 | Clevenger et al. | 415/115 |
| 4,946,346 | 8/1990 | Ito | 415/115 |
| 5,197,852 | 3/1993 | Walker et al. | 415/115 |

*Primary Examiner*—John T. Kwon

[57] ABSTRACT

A turbine vane for a gas turbine engine includes a platform with a cavity along the trailing edge having a double feed arrangement for injecting cooling fluid into the cavity. Various construction details are developed that provide a cavity having improved heat transfer due to the elimination of dead zones. In a particular embodiment, a turbine vane includes a platform cavity having a first inlet located on the pressure side of the platform and forward of an attachment rail and a second inlet located on the suction side and forward of the attachment rail. The cavity includes a plurality of trip strips and a plurality of film cooling passages. The trip strips extend from the corners of the cavity and are angled to encourage cooling fluid to flow into the corners. The film cooling passages direct the exiting cooling fluid to form a film of cooling fluid over the platform flow surface.

5 Claims, 2 Drawing Sheets

TURBINE VANE WITH A PLATFORM CAVITY HAVING A DOUBLE FEED FOR COOLING FLUID

TECHNICAL FIELD

The present invention relates to gas turbine engines, and more specifically to turbine vanes for such engines.

BACKGROUND OF THE INVENTION

Turbine vanes used in gas turbine engines orient the hot gases flowing through the turbine for efficient engagement with rotating blades downstream of the turbine vanes. A typical turbine vane includes an airfoil extending between an inner platform and an outer platform, wherein both platforms are integral to the turbine vane. The airfoil directs the flow into the array of rotating blades. The platforms provide the inner and outer flow surfaces that contain the flow of hot gases.

Exposure to the hot gases of combustion generates the need to cool the turbine vanes. Cooling fluid, typically bypass air drawn from a compressor upstream of the combustion process, is flowed through the hollow core of the airfoil to provide convective cooling. A plurality of cooling passages disposed in the airfoil provide means to flow the cooling fluid out of the airfoil and over the flow surfaces of the airfoil to provide film cooling of those surfaces. Platforms are typically cooled by impinging cooling fluid onto the surface opposite the flow surface. This cooling fluid may also flow through passages in the platform to provide film cooling of the flow surface of the platform.

An example of one type of platform cooling configuration is disclosed in U.S. Pat. No. 4,017,213, issued to Przirembel and entitled "Turbomachinery Vane or Blade with Cooled Platforms". This patent discloses a turbine vane or blade having a combination of impingement, convection and film cooling to cool the platform. In addition, this configuration includes an array of passages extending through the platform to convectively cool the trailing edge of the platform.

As combustion temperatures of modem gas turbine engines has risen, it has become increasingly necessary to provide as much cooling as possible to the platform, especially to the trailing edge of the platform. One problem encountered is that the trailing edge is typically downstream of a rail that attaches the turbine vane to the stator structure. Therefore, impingement cooling may not be possible in this region.

Another known configuration for cooling the platforms is shown in FIGS. 1 and 2. In this configuration, the trailing edge of the platform is cooled by flowing cooling fluid into a cavity that extends along the trailing edge of the platform. Cooling fluid exits the cavity through passages that direct the cooling fluid over the flow surfaces of the trailing edge. The cavity provides means to increase the cooling flow to the trailing edge and includes a plurality of trip strips to enhance heat transfer between the cooling fluid within the cavity and the platform. The general U-shape of the cavity is used to direct cooling fluid as close as possible to the corners of the trailing edge.

The above art notwithstanding, scientists and engineers under the direction of Applicants' Assignee are working to develop turbine vanes having configurations providing more effective cooling of the platforms.

DISCLOSURE OF THE INVENTION

According to the present invention, a turbine vane having a platform includes a cavity extending along the trailing edge and having a pair of inlets disposed on opposite sides of the vane. Each inlet permits fluid communication between the cavity and a common source of cooling fluid. The cavity includes a plurality of trip strips to enhance heat transfer between the platform and the cooling fluid. The trip strips are angled, relative to the direction of fluid flow through the cavity, to encourage cooling fluid to flow towards the corners of the cavity.

A principle feature of the present invention is the double feed arrangement of the cavity. Another feature is the distribution and orientation of the trip strips disposed within the cavity. A further feature is the cavity being cast into the platform.

A primary advantage of the present invention is the effective cooling of the trailing edge of the platform as a result of having two inlets providing cooling fluid into the cavity. Another advantage is the elimination of dead zones or regions of low cooling flow as a result of having the cavity fed on opposite sides and trip strips distributed throughout the cavity. In conventional vanes having cooled platforms, the cavity has a single feed located on either the pressure side or the suctions side of the platform. This arrangement may result in non-uniform distribution of cooling fluid throughout the cavity. Some regions of the cavity, such as the far corners of the cavity, may have less effective cooling than other regions. The double feed arrangement of applicant's invention provides a source of cooling fluid to both sides of the cavity. The trip strips are oriented to encourage cooling fluid flowing into each inlet to flow towards the corner nearest to the inlet. A further advantage of the present invention is the distribution of cooling fluid within the cavity. The distribution ensures a flow of cooling fluid to all areas of the cavity to provide effective convection and to all of the cooling passages for ejecting cooling fluid over the external surfaces of the platform.

Another advantage is the cost savings available as a result of being able to cast the cavity into the platform. In prior art platforms having cavities extending along the length of the platform trailing edge, a recess would be cast into the platform. In order to finish the cavity, a cover would be welded over the recess. The recess permitted access to the cavity to provide a second point of attachment for the casting core. In accordance with the present invention, the cavity has two inlets which provide two point support for the casting core. Therefore the additional step and cost of bonding a cover to the platform is not necessary.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Prior Art

Figure 2:
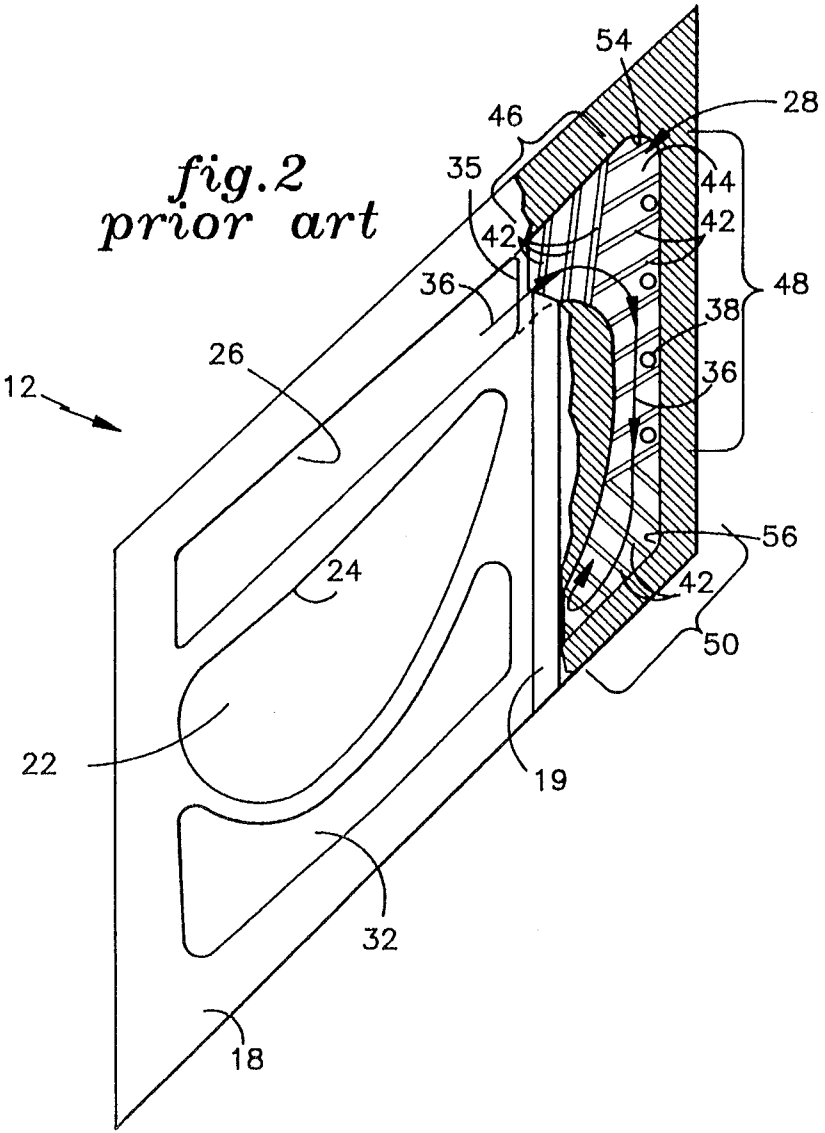
fig. 2 prior art
FIG. 2 is a view taken along line 2—2 of FIG. 1 of the prior art turbine vane.
Figure 1:
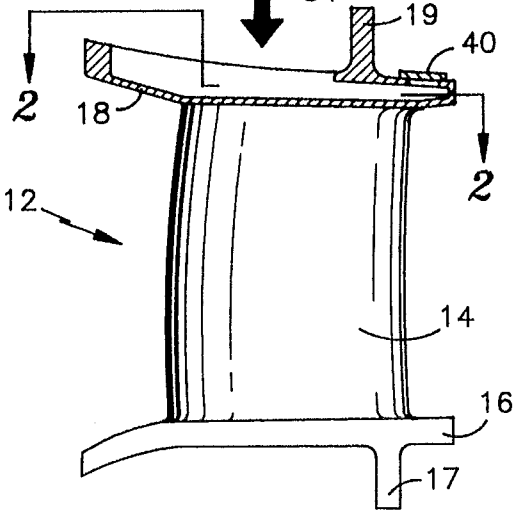
fig. 1 prior art
FIG. 1 is a side view, partially cut away, of a prior art turbine vane having a platform with a trailing edge cavity.

A turbine vane 12 in accordance with the prior art is illustrated in FIGS. 1 and 2. The turbine vane 12 includes an airfoil 14, an inner platform 16 having an inner rail 17, and an outer platform 18 having an outer rail 19. The rails 17, 19 permit the turbine vane 12 to be attached to stator structure of a gas turbine engine (not shown). The airfoil 14 has a hollow core 22 adapted to permit cooling fluid to flow through the turbine vane 12. The outer platform 18 includes an airfoil opening 24, a pressure side recess 26 in fluid communication with a trailing edge cavity 28, and a suction side recess 32.

Cooling fluid flowing radially inward (as shown by arrow 34) is divided between hollow core 22 and the recesses 26,32. A portion of the cooling fluid flowing into the pressure side recess 26 flows into the cavity 28. The cavity is generally U-shaped with an opening 35 at only one end. As shown by arrows 36, this fluid flows around and fills the cavity 28. The cooling fluid exits the cavity 28 through a plurality of passages 38 adapted to flow the exiting fluid over the flow surface of the outer platform 18.

The cavity 28 is defined by a cooling surface 44 and a cover plate 40. The cover plate 40 is bonded, such as by welding, to the underside of the platform. The cavity includes a plurality of trip strips 42 disposed on the cooling surface 44 of the cavity. The trip strips 42 upset the flow of cooling fluid to enhance the heat transfer between the cooling fluid and the cooling surface 44. The plurality of trip strips 42 are arranged in three groups 46,48,50 in order to maintain the trip strips at a skewed angle relative to the direction of cooling fluid flow over the trip strips. The first group 46 is adjacent the opening 35 of the cavity 28, the second group 48 extends along the trailing edge of the platform 16 from the near corner 54 to the far corner 56, and the third group 50 extends from the far corner 56 to the end of the cavity 28.

During operation, cooling fluid flows radially inward toward the outer platform 18, as indicated by arrow 34 of FIG. 1. This fluid is divided between the core 22, the pressure side recess 26 and the suction side recess 32. Fluid flowing into the core 22 cools the airfoil 14. Fluid flowing into the suction side recess 32 convectively cools the platform in the vicinity of the recess 32 and then flows through film cooling passages to provide a layer of cooling fluid over the flow surface of the outer platform 18. A portion of the fluid flowing into the pressure side recess 26 also convectively cools the platform 18 in the vicinity of the recess 26 and flows through film cooling passages to film cool the flow surface of the platform 18. The remainder of the fluid flowing into the pressure side recess 26 flows through opening 35, under the outer rail 19, and into cavity 28. Within cavity 28, the cooling fluid flows over the trip strips 42 to produce a regenerative boundary layer. The fluid flows to a first corner 54 and then turns and flows along the trailing edge. As it flows along the trailing edge, the fluid escapes the cavity 28 through film cooling passages 38 that generate a layer of cooling fluid over the trailing edge. A portion of the fluid continues to flow through the cavity 28 to the far corner 56. Due to the distance traveled (over trip strips 42) and to the loss of fluid through film cooling passages 38, the fluid that reaches the far corner 56 is at a relatively high temperature and low pressure. In addition, the far corner 56 is a termination point for flow through the cavity 28. As a result, fluid velocity is low and minimum heat transfer takes place in the far corner 56.

Figure 3B:
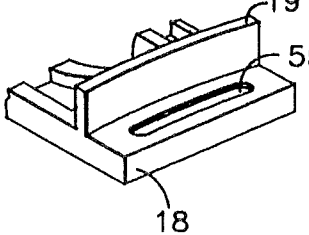
FIG. 3*a* and 3*b* are side views, partially cut away, of a turbine vane having a platform cavity in accordance with the invention.
Figure 3A:
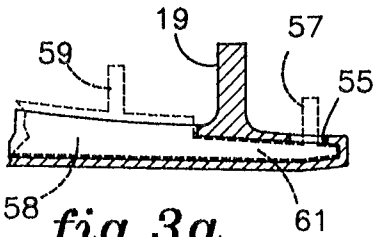

As shown in FIGS. 3*a* and *b*, a method of forming the cavity 28 includes casting a recess 5.5 into the trailing edge region of the platform 18. After the casting process is completed, the cover plate 40 is welded onto the platform 18 to seal the recess 55 (except for opening 35) and define the cavity 28. A recess is required during the casting process to provide a second point 56 of support for the ceramic core 58 used to form the cavity 28. The first point 59 of support is provided by an extension 61 passing through and forming the opening 35.

Embodiment of the Invention

Figure 5:
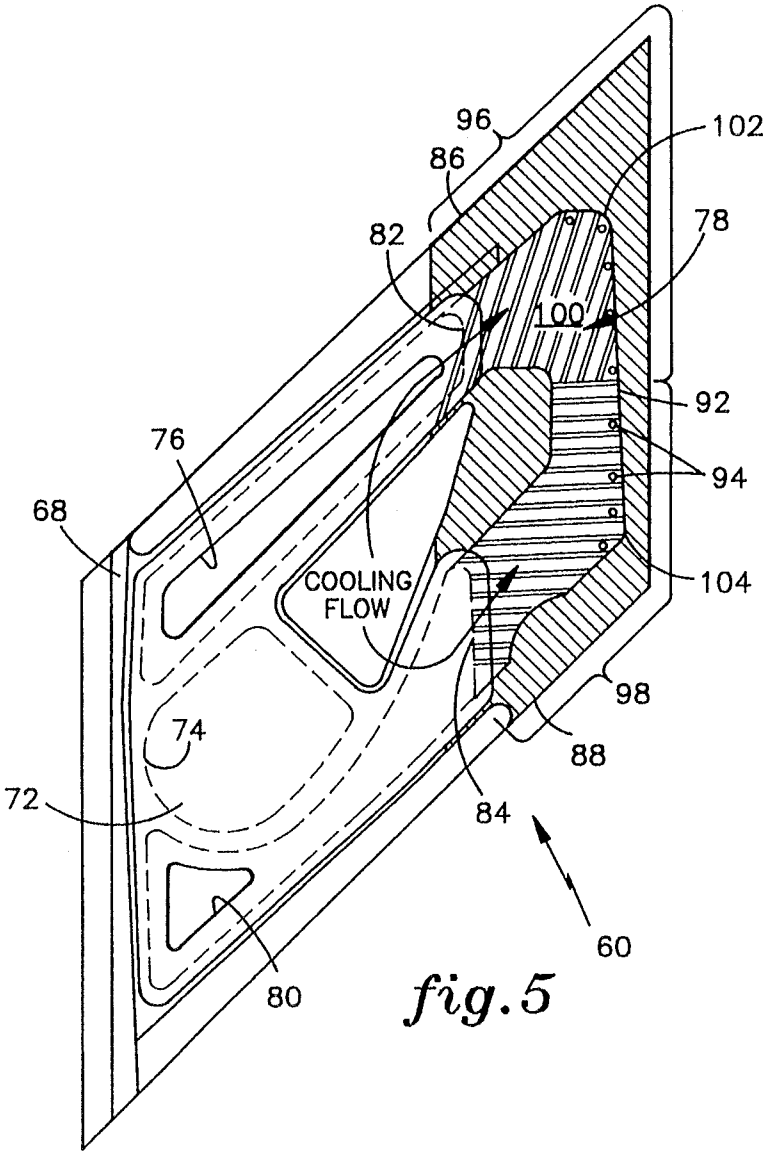
FIG. 5 is a view taken along line 4—4 of FIG. 4 of the platform cavity.
Figure 4:
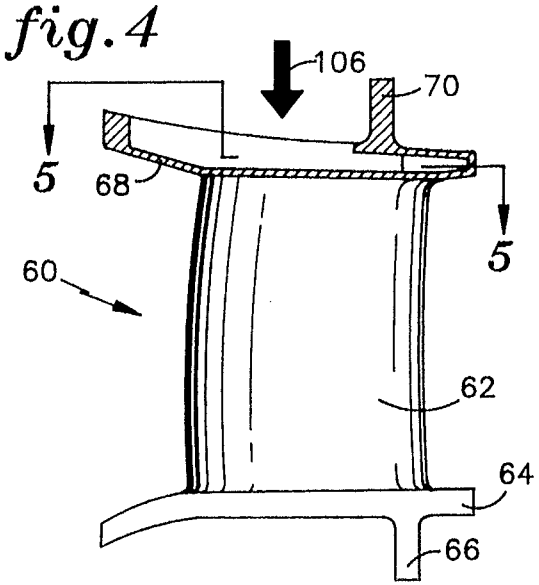
FIG. 4 is a side view of the invention.

FIGS. 4 and 5 illustrate an embodiment of a turbine vane 60 according to the invention. The turbine vane 60 includes an airfoil 62, an inner platform 64 having an inner rail 66, and an outer platform 68 having an outer rail 70. The airfoil 62 has a hollow core 72 adapted to permit cooling fluid to flow through the turbine vane 60. The outer platform 68 includes an airfoil opening 74, a pressure side recess 76 in fluid communication with a trailing edge cavity 78, and a suction side recess 80 also in fluid communication with the trailing edge cavity 78.

As with the prior art turbine vane 12 shown in FIGS. 1 and 2, cooling fluid flowing radially inward is divided between the hollow core 72 and the two recesses 76,80. Fluid flowing into both recesses 76,80, however, flows into the cavity 78. The cavity 78, which is again generally U-shaped but with two openings 82,84, permits fluid to flow aft along both sides 86,88 toward the trailing edge and then toward the middle 92. As a result, the cooling fluid within the cavity is more uniformly distributed from side to side. As with the prior art turbine vane 12, the cooling fluid exits the cavity 78 through a plurality of passages 94 adapted to flow the exiting fluid over the flow surface of the outer platform 68.

The cavity 78 includes two groups of trip strips 96,98 distributed throughout the cavity 78 and over the cooling surface 100 of the cavity 78. The first group 96 extend from adjacent the pressure side opening 82 to the middle 92 of the cavity 78. The first group of trip strips 96 are angled so as to be skewed relative to the flow entering the cavity 78 through the pressure side opening 82 and to urge the cooling fluid to flow into the corner 102 of the cavity 78.

The second group of trip strips 98 extend from the middle 92 of the cavity 78 to the suction side opening 84. The second group 98 are angled so as to be skewed relative to the flow entering the cavity 78 through the suction side opening 84 and to urge the cooling fluid to flow into the corner 104 of the cavity 78.

During operation, cooling fluid flows radially inward onto the outer platform 68 as indicated by arrow 106 of FIG. 4. As with the prior art embodiment shown in FIGS. 1 and 2, this cooling fluid is divided between the core 72, the pressure side recess 76, and the suction side recess 80. The fluid flowing into the core 72 provides cooling for the airfoil 62. The cooling fluid flowing into the two recesses 76,80 provides convective cooling of the outer platform 68 in the vicinity of the recesses 76,80 and flows through film cooling passages to film cool the flow surface of the outer platform 68. The remainder of the cooling fluid flowing into the recesses 76,80 flows through openings 82,84, respectively, and into the cavity 78. The fluid flowing through opening 82 engages the first set of trip strips 96. These trip strips 96 produce a regenerative boundary layer and, because of the particular skew of the trip strips 96 and their extension into corner 102, encourage the fluid flowing through opening 82 to flow towards the corner 102. The fluid flowing through opening 84 engages the second set of trip strips 98. These trips strips 98 also produce a regenerative boundary layer but encourage fluid flowing through opening 84 to flow towards corner 104. Both streams of fluid flow along the trailing edge and engage at a point about midway of the cavity, which corresponds to the point at which the two sets of trip strips 96,98 mate. As a result of this double feed arrangement and the trip strips 96,98 encouraging fluid flow into the corners 102, 104, there are no hard termination points and therefore no 'dead zones' within the cavity 78 where fluid velocity is minimal. The elimination of dead zones improves the heat transfer along the entire trailing edge. In addition, the more uniform flow pressure and velocity results in a more uniform distribution of fluid through the film cooling passages 94 and therefore in a more uniform film of cooling fluid over the trailing edge.

Figure 6:
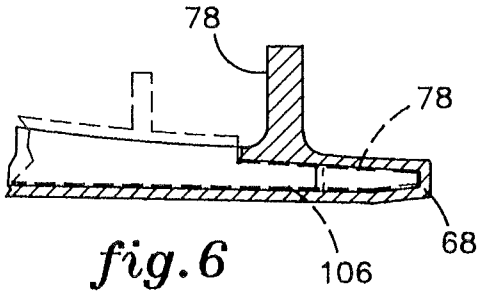
FIG. 6 is a side view, partially cut away, of a turbine vane having cavity in accordance with the invention.

As illustrated in FIG. 6, forming the cavity 78 in the platform 68 may be accomplished during the casting process. Since the cavity 78 has two openings 82,84, two point support is provided by the ceramic core extensions 106 that form the openings 82,84. Therefore, there is no need for a support extending out of the cavity 78, such as shown in FIG. 3*a*, and for a step of bonding a cover plate to seal the cavity 78.

Although illustrated in FIGS. 4 and 5 as a vane having an outer platform including a cavity having the invention incorporated therein, it should be noted that either or both of the platforms of a turbine vane may have Applicant's invention incorporated therein.

Although the invention has been shown and described with respect with exemplary embodiments thereof, it should be understood by those skilled in the art that various changes, omissions, and additions may be made thereto, without departing from the spirit and scope of the invention.

I claim:

1. A turbine vane having an airfoil and a platform extending about and laterally from the airfoil, the airfoil having a pressure side, a suction side, and a trailing edge, the platform including:

a flow surface, a rail adapted to provide attachment means for the turbine vane, a platform trailing edge downstream of the airfoil trailing edge, the platform trailing edge including a first corner and a second corner, the first corner located on the pressure side and the second corner located on the suction side, and a cavity, the cavity extending under the rail and into the platform trailing edge, the cavity having a cooling surface, a first inlet located on the pressure side, a second inlet located on the suction side, and a plurality of passages extending between the cavity and the flow surface, the cooling surface including a plurality of trip strips disposed thereon, the trip strips engaging fluid flowing through the cavity to disturb the flow of fluid and enhance heat transfer between the fluid and the cooling surface, the trip strips including a first group and a second group, the first group being adjacent the first inlet and angled, relative to the direction of flow through the first inlet, to encourage flow towards the first corner, the second group being adjacent the second inlet and angled, relative to the direction of flow through the second inlet, to encourage flow towards the second corner.

2. The turbine vane according to claim 1, wherein the plurality of trip strips extend through the cavity and along the extent of the platform trailing edge, such that the first group of trip strips abuts the second group of trip strips.

3. The turbine vane according to claim 1, wherein the first set of trip strips extend towards and into the first corner and wherein the second set of trip strips extend towards and into the second corner.

4. The turbine vane according to claim 1, further including a plurality of film cooling passages extending between the cavity and the flow surface of the platform, the film cooling passages directing cooling fluid exiting the cavity to flow over the flow surface of the platform.

5. The turbine vane according to claim 1, further including a second platform disposed oppositely of the first platform and extending about and laterally from the airfoil, the second platform including:

a flow surface, a rail adapted to provide attachment means for the turbine vane, a platform trailing edge downstream of the airfoil trailing edge, the platform trailing edge including a first corner and a second corner, the first corner located on the pressure side and the second corner located on the suction side, and a cavity, the cavity extending under the rail and into the platform trailing edge, the cavity having a cooling surface, a first inlet located on the pressure side, a second inlet located on the suction side, and a plurality of passages extending between the cavity and the flow surface, the cooling surface including a plurality of trip strips disposed thereon, the trip strips engaging fluid flowing through the cavity to disturb the flow of fluid and enhance heat transfer between the fluid and the cooling surface, the trip strips including a first group and a second group, the first group being adjacent the first inlet and angled, relative to the direction of flow through the first inlet, to encourage flow towards the first corner, the second group being adjacent the second inlet and angled, relative to the direction of flow through the second inlet, to encourage flow towards the second corner.

* * * * *

UNITED STATES PATENT AND TRADEMARK OFFICE

CERTIFICATE OF CORRECTION

PATENT NO. : 5,413,458

DATED : May 9, 1995

INVENTOR(S) : John C. Calderbank

It is certified that error appears in the above-identified patent and that said Letters Patent is hereby corrected as shown below:

Col. 3, Lines 1-3, delete these lines and substitute --
--FIG. 3A is a fragmentary sectional elevation of a recess being cast into a vane platform of the type illustrated in Fig. 1.--

--FIG. 3B is a fragmentary isometric view of the platform and recess illustrated in Fig. 3A.--

Col. 3, lines 5-6, delete these lines and substitute
--Fig. 5 is a view of the platform cavity taken along line 5-5 of Fig. 4.--

Col. 4, Line 14, delete "recess 5.5" and substitute --recess 55--;
Col. 4, Line 19, delete "56" and substitute --57--.

In the drawings: FIG. 6 delete reference numeral "106" and substitute --108--;
Col. 5, Line39, delete "106" and substitute --108--.

Signed and Sealed this

Eighth Day of August, 1995

Bruce Lehman

*Attest:*

BRUCE LEHMAN

*Attesting Officer*

*Commissioner of Patents and Trademarks*